US012114690B2

(12) United States Patent
Iadanza et al.

(10) Patent No.: US 12,114,690 B2
(45) Date of Patent: Oct. 15, 2024

(54) AEROSOL-GENERATING ARTICLE AND APPARATUS FOR FORMING AN AEROSOL-GENERATING ARTICLE

(71) Applicant: PHILIP MORRIS PRODUCTS S.A., Neuchatel (CH)

(72) Inventors: Clemente Iadanza, Bologna (IT); Lorenzo Righi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 448 days.

(21) Appl. No.: 17/251,357

(22) PCT Filed: Jun. 21, 2019

(86) PCT No.: PCT/EP2019/066548
§ 371 (c)(1),
(2) Date: Dec. 11, 2020

(87) PCT Pub. No.: WO2020/002165
PCT Pub. Date: Jan. 2, 2020

(65) Prior Publication Data

US 2021/0244079 A1 Aug. 12, 2021

(30) Foreign Application Priority Data

Jun. 27, 2018 (EP) ..... 18180249

(51) Int. Cl.
*A24C 5/00* (2020.01)
*A24D 1/02* (2006.01)

(52) U.S. Cl.
CPC ..... *A24C 5/005* (2013.01); *A24D 1/02* (2013.01)

(58) Field of Classification Search
CPC .. A24C 5/10; A24C 5/005; A24C 5/01; A24D 1/025; A24D 1/00; A24D 1/02
See application file for complete search history.

(56) References Cited

U.S. PATENT DOCUMENTS 2,890,704 A 6/1959 Lamm
6,810,884 B2 * 11/2004 Snaidr ..... A24D 1/02 131/365

(Continued)

FOREIGN PATENT DOCUMENTS

JP 2013-521814 6/2013
JP 2015-502159 1/2015

(Continued)

OTHER PUBLICATIONS

Park Sin Taek, et all, "KR 20070054788 A, KR 20070054788 A", machine translation (Year: 2005).*

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

The present invention relates to an aerosol-generating article (10) for use with an aerosol-generating device comprising a heating element, or with an integral heat source, the aerosol-generating article (10) comprising an aerosol-forming substrate (20), a substantially incombustible wrapper (3) circumscribing the aerosol-forming substrate (20) and comprising inner and outer surfaces, wherein the inner surface of the wrapper (3) has an at least partially textured surface (5) configured to overlap a portion of the outer surface (4) of the wrapper (3) when the wrapper (3) is wrapped around the aerosol-forming substrate (20). The invention further relates to an apparatus and a method for forming an aerosol-generating article (10).

12 Claims, 13 Drawing Sheets

(56) References Cited

U.S. PATENT DOCUMENTS

| | | | | |
|---|---|---|---|---|
| 9,339,059 | B2 | 5/2016 | Griesmayr | |
| 9,364,022 | B2 | 6/2016 | Kaljura | |
| 10,595,558 | B2 | 3/2020 | Malgat | |
| 2005/0172976 | A1 | 8/2005 | Newman | |
| 2013/0139837 | A1* | 6/2013 | Kaljura | B31F 1/07 131/365 |
| 2013/0199551 | A1* | 8/2013 | Le Roux | A24C 5/471 131/365 |
| 2015/0272203 | A1* | 10/2015 | Holford | A24C 5/10 131/365 |
| 2016/0000141 | A1* | 1/2016 | Nappi | A24C 5/601 131/365 |
| 2016/0120216 | A1 | 5/2016 | Mironov | |
| 2018/0228207 | A1* | 8/2018 | Meusel | D21H 27/00 |

FOREIGN PATENT DOCUMENTS

| | | | | |
|---|---|---|---|---|
| JP | 2016-523567 | | 8/2016 | |
| JP | 2018-514194 | | 6/2018 | |
| KR | 20070054788 | A * | 11/2005 | A24D 1/02 |
| WO | WO 02/24006 | | 3/2002 | |
| WO | WO 2012/164009 | | 12/2012 | |
| WO | WO 2013/009840 | | 1/2013 | |
| WO | WO 2015/082653 | | 6/2015 | |
| WO | WO 2017/036951 | | 3/2017 | |
| WO | WO 2018/007257 | | 1/2018 | |

OTHER PUBLICATIONS

Search Report and Written Opinion for PCT/EP2019/066548 dated Sep. 16, 2019 (15 pages).

International Preliminary Report on Patentability for PCT/EP2019/066548 dated Oct. 15, 2020 (17 pages).

European Search Report for Application No. 18180249.7 dated May 7, 2019 (11 pages).

Office Action issued in Japan for Application No. 202-568762 dated Apr. 17, 2023 (6 pages). English translation included.

Office Action issued in Mexico for Application No. MX/a/2020/013333 dated Aug. 6, 2024 (5 pages).

* cited by examiner

AEROSOL-GENERATING ARTICLE AND APPARATUS FOR FORMING AN AEROSOL-GENERATING ARTICLE

This application is a U.S. National Stage Application of International Application No. PCT/EP2019/066548 filed Jun. 21, 2019, which was published in English on Jan. 2, 2020 as International Publication No. WO 2020/002165 A1. International Application No. PCT/EP2019/066548 claims priority to European Application No. 18180249.7 filed Jun. 27, 2018.

The present invention relates to an aerosol-generating article comprising an aerosol forming substrate for generating an inhalable aerosol when heated by a heating element of an aerosol-generating device or an integral heating element. The present invention also relates to an apparatus for making such an aerosol-generating article and to a method of making such an aerosol-generating article.

A number of smoking articles in which tobacco is heated rather than combusted have been proposed in the art. One aim of such heated smoking articles is to reduce known harmful smoke constituents of the type produced by the combustion and pyrolytic degradation of tobacco in conventional cigarettes.

Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

A number of prior art documents disclose aerosol-generating devices for consuming or smoking heated smoking articles. Such devices include, for example, electrically heated aerosol-generating devices in which an aerosol is generated by the transfer of heat from one or more electrical heating elements of the aerosol-generating device to the aerosol-forming substrate of a heated smoking article. One advantage of such electrical smoking systems is that they significantly reduce sidestream smoke, while permitting a user to selectively suspend and reinitiate smoking.

An example of an electrically heated cigarette used in an electrical smoking system is disclosed in US 2005/0172976 A1. The electrically heated cigarette is constructed to be inserted into a cigarette receiver of a reusable lighter of an electrical smoking system. The lighter includes a power source that supplies energy to a heater fixture including a plurality of electrically resistive heating elements, which are arranged to slidingly receive the cigarette such that the heating elements are positioned alongside the cigarette. The electrically heated cigarette used in an electrical smoking system disclosed in US 2005/0172976 A1 may provide the energy to the electrically heated cigarette using pulsed heating.

As described above, the electrically heated cigarette disclosed in US 2005/0172976 A1 is for use in an electrical smoking system comprising a plurality of external heating elements. Electrical smoking systems comprising aerosol-generating devices with internal heating elements are also known. In use, the internal heating elements of the aerosol-generating devices of such electrical smoking systems are inserted into the aerosol-forming substrate of a heated smoking article such that the internal heating elements are in direct contact with the aerosol-forming substrate.

Direct contact between the internal heating element of an aerosol-generating device and the aerosol-forming substrate of a heated smoking article can provide efficient means for heating the aerosol-forming substrate to form an inhalable aerosol. In such a configuration, heat from the internal heating element may be conveyed almost instantaneously to at least a portion of the aerosol-forming substrate when the internal heating element is actuated, and this may facilitate the rapid generation of an aerosol. Furthermore, the overall heating energy required to generate an aerosol may be lower than would be the case in a smoking system comprising an external heater element whether aerosol-forming substrate does not directly contract the external heating element and initial heating of the aerosol-forming substrate occurs by convection or radiation. Where an internal heating element of an aerosol-generating device is in direct contact with an aerosol-forming substrate, initial heating of portions of the aerosol-forming substrate that are in direct contact with the internal heating element will be effected by conduction.

In alternative heated smoking articles, an aerosol is generated by the transfer of heat from a heat source forming part of the heated smoking article and being adjacent to the aerosol-forming substrate or material. The heat source may be located within, around or, most typically, upstream of the aerosol-forming substrate or material.

Where the heat source of a heated smoking article is in direct contact with an aerosol-forming substrate, initial heating of portions of the aerosol-forming substrate that are in direct contact with the heating source will be effected by conduction.

The present invention provides at least an alternative to aerosol-generating articles of the prior art. In particular, the present invention relates to an aerosol-generating article comprising an aerosol-forming substrate for generating an inhalable aerosol when heated by an internal or an external heating element. The invention also relates to an apparatus and to a method for making such an aerosol-generating article.

Aspects of the invention provide an aerosol-generating article for use with an aerosol-generating device comprising a heating element, an aerosol-generating article comprising a heating element and apparatus and a method for forming an embossed wrapper for circumscribing an aerosol-forming substrate according to the appended claims.

In accordance with an aspect of the invention there is provided an aerosol-generating article for use with an aerosol-generating device comprising a heating element, the aerosol-generating article comprising an aerosol-forming substrate, a substantially incombustible wrapper circumscribing the aerosol-forming substrate and comprising inner and outer surfaces, wherein the inner surface of the wrapper has an at least partially textured surface configured to overlap a portion of the outer surface of the wrapper when the wrapper is wrapped around the aerosol-forming substrate. In this way, the textured surface can be adhered to the outer surface of the wrapper. Without wishing to be bound by theory, the textured surface increases the surface area to which adhesive can be applied thereby increasing the adhesion force between the inner and outer surfaces of the wrapper. Thus, when the textured surface is adhered to the outer surface by adhesive, separation of the wrapper inner and outer surfaces is avoided.

In accordance with a further aspect of the invention there is provided an aerosol-generating article comprising an aerosol-forming substrate comprising one or more of tobacco and a source of nicotine, a heating element at the upstream end of the aerosol-forming substrate and being arranged to heat the aerosol-forming substrate so as to form an aerosol when actuated, a substantially incombustible wrapper circumscribing the aerosol-forming substrate and at least a portion of the heating element, the wrapper comprising inner and outer surfaces, wherein the inner surface of the wrapper has an at least partially textured surface configured to overlap a portion of the outer surface of the wrapper when the wrapper is wrapped around the aerosol-forming substrate. Thus, when the textured surface is adhered to the outer surface by adhesive, separation of the wrapper inner and outer surfaces is avoided.

As used herein "substantially incombustible wrapper" is used to describe a wrapper comprising a heat-conductive incombustible layer.

In certain embodiments the at least partially textured surface is embossed. More specifically the embossed surface comprises a pattern of raised and indented portions of the material of the substantially incombustible wrapper.

In certain embodiments, the pattern of raised and indented portions of the material of the substantially incombustible wrapper is a regular pattern.

As used herein, the term "regular pattern" is used to describe a pattern comprising a regular array of raised and indented portions of the material of the substantially incombustible wrapper.

In certain embodiments, the pattern of raised and indented portions of the material of the substantially incombustible wrapper is an irregular pattern.

As used herein, the term "irregular pattern" is used to describe a pattern comprising a non-repetitive or random array of raised and indented portions of the material of the substantially incombustible wrapper.

In certain embodiments, the textured surface is formed by deforming the wrapper. For example, the textured surface may be formed by embossing, stamping or pressing the wrapper.

In certain embodiments, the substantially incombustible wrapper has a smooth outer surface. That is to say, the texture of the inner surface extends through a partial thickness of the wrapper. In this way, the visual integrity of the outer wrapper visible to the user remains intact. The textured surface of the inner surface does not affect the overall appearance of the product.

In certain embodiments, the portion of the substantially incombustible wrapper having a textured surface extends partially around the circumference of the aerosol-forming substrate. More specifically, the inner surface of the substantially incombustible wrapper comprises a textured portion and a smooth portion. Yet more specifically, the substantially incombustible wrapper comprises a longitudinal strip of textured portion and a longitudinal strip of smooth portion.

In certain embodiments, the textured portion extends along an edge of the substantially incombustible wrapper. More specifically, the textured portion extends along a longitudinal edge of the substantially incombustible wrapper. In this way, the textured portion forms that portion of the inner surface of the wrapper that will overlap the outer surface of the opposing edge of the wrapper when the wrapper circumscribes the aerosol-forming substrate. Thus, the texture on the inner wrapper does not affect the portion of the wrapper in contact with the aerosol-forming substrate. More specifically, the smooth portion of the inner surface of the substantially incombustible wrapper is in contact with the aerosol-forming substrate and the textured portion of the inner surface of the substantially incombustible wrapper forms the wrapper seam with a portion of the outer surface of the substantially incombustible wrapper when the wrapper circumscribes the aerosol-forming substrate. In this way, the adhesive strength of the wrapper seam is improved without changing the wrapper surface at the interface with the aerosol-forming substrate.

In certain embodiments, the textured portion is between about 10 millimetres and about 20 millimetres wide. More specifically, the textured portion may be 15 millimetres wide. The width of the portion is measured across the transverse (shorter) dimension of the substantially incombustible wrapper. In this way, the textured portion is provided at the overlap between the edges of the wrapper when is it wrapped around the aerosol-forming substrate. Thus, the textured portion forms one surface of the seam between the inner and outer surfaces of the wrapper.

In certain embodiments the textured portion is entirely covered by the outer surface of the wrapper when the wrapper circumscribes the aerosol-forming substrate. In this way, the textured portion does not disrupt the inner or the outer surface of the wrapper when it is circumscribing the aerosol-forming substrate.

In certain embodiments, the portion of the inner surface of the substantially incombustible wrapper having a textured surface overlaps a portion of the outer surface of the substantially incombustible wrapper. More specifically, the portion of the inner surface of the substantially incombustible wrapper having a textured surface overlaps and is adhered to a portion of the outer surface of the substantially incombustible wrapper. In certain embodiments, adhesive is applied to the inner surface of the substantially incombustible wrapper having a textured surface before the overlapping portion of the inner surface is adhered to the outer surface of the substantially incombustible wrapper. In this way, the adhesion between the overlapping inner and outer surfaces is improved when compared to overlapping smooth surfaces.

In certain embodiments, the portion of the inner surface of the substantially incombustible wrapper having a textured surface and the portion of the outer surface of the substantially incombustible wrapper which the textured portion of the inner surface overlaps together form a lap seam when adhered.

In certain embodiments, the substantially incombustible wrapper comprises a metallic heat-conductive layer.

In certain embodiments at least the inner surface of the substantially incombustible wrapper is metallic. A metallic surface typically presents a challenge when applying adhesive as the surface is non-porous (or impervious). As a result, adhering a metallic inner surface to an outer surface of the substantially incombustible wrapper may result in a gaping seam or similar lack of adhesive of the substantially incombustible wrapper at the seam with the result that it has a tendency to come apart.

In certain embodiments, the textured portion of the metallic inner surface is adhesively joined to the outer surface of the opposite edge of the wrapper. In this way, the textured portion of the inner surface of the substantially incombustible wrapper ensures greater adhesion with the outer portion of the substantially incombustible wrapper when the wrapper circumscribes the aerosol-forming substrate.

In certain embodiments the metallic heat-conductive layer comprises one or more of: a metallised paper and a metallic foil. Yet more specifically, the wrapper comprises aluminium foil.

As used herein, the term "metallised paper" is used to describe a metal carried on a paper substrate. For example, paper comprising vapour deposited metal.

In certain embodiments the substantially incombustible wrapper comprises two layers. More specifically, the wrapper comprises at least two layers of which the innermost layer against the aerosol-forming substrate comprises the at least partially textured surface.

In certain embodiments the substantially incombustible wrapper may comprise a layer of metallic heat conductive material and a layer of heat-insulative material.

In certain embodiments the substantially incombustible wrapper comprises a low porosity paper.

In certain embodiments the substantially incombustible wrapper may comprise a layer of paper and a layer of metallic foil. Yet more specifically, the substantially incombustible wrapper may comprise a paper layer and a metallic foil layer bonded together by a lamination process.

In certain embodiments the paper layer may be a plug wrap.

In certain embodiments the paper layer may be formed of a paper having a basis weight of about 45 grams per square metre ($gsm^{-1}$).

In certain embodiments the paper layer may be formed of a paper having a thickness of 65 micrometres (μm).

In certain embodiments the metallic foil layer may be formed of an aluminium foil having a basis weight of about 17 grams per square metre ($gsm^{-1}$).

In certain embodiments the metallic foil layer may be formed of an aluminium foil having a thickness of 6.3 micrometres (μm).

In certain embodiments, the two-layer laminated paper and aluminium substantially incombustible wrapper having a basis weight of about 62 grams per square metre ($gsm^{-1}$).

In certain embodiments, the two-layer laminated paper and aluminium substantially incombustible wrapper having a thickness of 71.3 micrometres (μm).

In certain embodiments the substantially incombustible wrapper extends over at least a portion of the length of the aerosol-forming substrate. In certain embodiments, the substantially incombustible wrapper extends over the whole length of the aerosol-forming substrate. When the substantially incombustible wrapper comprises a heat conductive inner layer or surface (such as a metallic layer or surface) in contact with the aerosol-forming substrate, the inner layer or surface has a heating conducting effect along the aerosol-forming substrate from the upstream to the downstream end.

In certain embodiments the substantially incombustible wrapper extends over the length of the aerosol-forming substrate and the heating element at the upstream end of the aerosol-forming substrate. In this way, when the aerosol-generating article comprises an integral heat source, the heat source is retained in the article by the substantially incombustible wrapper. In addition, the heat conductive inner layer or surface prevents the lighting of the heat source when wrapped around it.

In certain embodiments the substantially incombustible wrapper is unventilated.

In certain embodiments the substantially incombustible wrapper is ventilated. In embodiments comprising an integral heat source, ventilation in the substantially incombustible wrapper allows air flow through the aerosol-forming article.

In certain embodiments the aerosol-forming substrate comprises tobacco. In such embodiments, the aerosol-generating article is a heated smoking article.

In certain embodiments the aerosol-forming substrate comprises a source of nicotine. In such embodiments, the aerosol-generating article is a heated smoking article.

According to a further aspect, the present invention provides an apparatus for forming an embossed wrapper for circumscribing an aerosol-forming substrate, the apparatus comprising a pair of nip rollers, one or the rollers in the pair being an embossing roller comprising a profiled surface for creating an embossed pattern and the other one of the rollers in the pair being a smooth surfaced roller, the pair of rollers being configured (adapted, arranged) to receive a web of substantially incombustible wrapper material between the embossing roller and the smooth surfaced the embossing roller being configured to form a textured pattern in a portion of the width of the web of substantially incombustible wrapper material as it passes between the pair of rollers.

In certain embodiments, the distance between the surfaces of the embossing roller and the smooth surfaced roller is adjustable. In this way, the pressure of the embossing roller against the web of incombustible material is adjustable. The depth of the embossing on the substantially incombustible wrapper can be controlled in this way.

In certain embodiments, the surface of the embossing roller has a plurality of teeth.

In certain embodiments, the surface of the embossing roller has a plurality of teeth across a portion of the transverse width of the roller. More specifically, the surface of the embossing roller has a smooth portion and a portion comprising teeth across its transverse width.

In certain embodiments the teeth are of any suitable profile. More specifically, the teeth may extend transversely on the surface of the roller. More specifically, the teeth may be separated by triangular recesses in the surface of the embossing roller and extending transversely relative to the direction of travel of the web of wrapper material. Alternatively, the teeth may extend both circumferentially and transversely on the surface of the embossing roller.

In certain embodiments, the teeth are 1 millimetre or more in height. The outer layer or surface of the substantially incombustible wrapper faces the smooth surface of the counter roller and the distance between the rollers is adjustable, so that whatever the size of the teeth, the depth of the embossing may be adjusted accordingly, and the outer layer or surface of the substantially incombustible wrapper will not be changed by the embossing roller.

In certain embodiments, the profiled surface of the embossing roller is between 10 millimetres and 20 millimetres wide. For example, the profiled surface is 15 millimetres wide. Typically the embossing surface of the roller is between 0.5 millimetres and 10 millimetres wide; or between 1 millimetre and 8 millimetres wide; or between 1 millimetre and 6 millimetres wide; or between 1 millimetre and 5 millimetres wide; or between 2 millimetres and 5 millimetres wide. This profiled surface of the roller can correspond to the textured surface on the inner surface of the wrapper. Thus, the textured surface on the inner surface of the wrapper may typically be between 0.5 millimetres and 10 millimetres wide; or between 1 millimetre and 8 millimetres wide; or between 1 millimetre and 6 millimetres wide; or between 1 millimetre and 5 millimetres wide; or between 2 millimetres and 5 millimetres wide. Typically also between 1 millimetre and 2 millimetres wide, for example 1.5 millimetres wide.

In certain embodiments the embossing roller has an outer diameter of between about 10 millimetres and about 40 millimetres. More specifically, the embossing roller has an outer diameter of about 30 millimetres.

In certain embodiments the embossing roller has a core diameter of between about 8 millimetres and about 36 millimetres. More specifically, the embossing roller has a core diameter of about 26 millimetres.

In certain embodiments the smooth surfaced roller has a core diameter of between about 8 millimetres and about 36 millimetres. More specifically, the embossing roller has a core diameter of about 26 millimetres.

In certain embodiments the embossing roller is interchangeable with another embossing roller having a different profiled surface (at least one for each teeth design). More specifically, each embossing roller comprises a hollow core of the same diameter (between about 8 millimetres to about 36 millimetres, preferably 26 millimetres). In this way an embossing roller can be easily and quickly mounted on the same shaft which can be fixed onto a crimper machine, for example. The embossing rollers may be fixed to the shaft via a cotter pin to block their rotation relative to the shaft.

In certain embodiments the shaft of the rollers may be free moving or motorized. A free moving shaft helps to make installation easy.

In certain embodiments the embossing roller and the smooth surfaced roller each have a hollow core. In this way, the pair of rollers can be easily and quickly mounted on to a respective shaft which can be fixed on to a tobacco crimper machine, for example.

In certain embodiments each of the pair of rollers is fixed to the shaft with a cotter pin. The pin prevents rotation of the rollers as the web of substantially incombustible wrapper material passes between the embossing roller and the counter (smooth) roller.

In certain embodiments the shaft of the one or each of the embossing roller and the smooth surfaced roller may be free moving or motorized. More specifically the shaft of the one or each of the embossing roller and the smooth surfaced roller may be free moving. This free movement facilitates easy installation of the apparatus into a larger machine (such as a tobacco crimper machine, for example).

In certain embodiments, the pair of embossing rollers are installed on a tobacco crimper machine, on the path of the feeding of the wrapper material, before the wrapping of the aerosol-forming substrate with the substantially incombustible wrapper. In such machine, because the wrapper material is initially delivered on a bobbin, there is a need to splice the wrapper from consecutive bobbins together. In such embodiments, at least one splicing sensor is provided. So as not to disturb such splicing sensor, the pair of rollers are installed immediately after the splicing sensor in the direction of travel of the web of substantially incombustible wrapper material.

In certain embodiments, the upper layer (paper side) of the plug wrap is in contact with the counter (smooth surfaced) roller (top roller), while the inner layer (aluminium side) is in contact with the embossing roller (bottom roller). For this reason, only the inner layer (aluminium side) will be textured as the wrapper passes between the pair of rollers.

Such treatment has no impact on the outer layer that can be visible for the smoking article users, and so no impact on the outside of the rod, thus the visual quality of the wrapper is not impacted by the embossing.

In certain embodiments, the contact pressure between the two rollers and the wrapping material is adjustable. This can be done for instance by moving an endless screw so as to change the distance between the two rollers and so the contact pressure between them. In this way the embossing depth of the wrapper material is adjustable. By changing the depth of the embossing on the wrapper material, the adhesion strength between the outer and inner layers of the wrapper when adhesive is applied is controllable.

In a yet further aspect of the present invention there is provided a method of forming an aerosol-generating article comprising embossing the inner surface of an substantially incombustible wrapper, forming a rod of aerosol-forming substrate on the embossed wrapper, circumscribing the aerosol-forming substrate with the embossed wrapper, applying adhesive to a portion of the embossed inner surface which portion overlaps a portion of the outer surface of the wrapper, closing the wrapper about the aerosol-forming substrate by adhering the overlapping portion of the embossed inner surface to the outer surface of the wrapper.

In a yet further aspect of the present invention there is provided a method of forming an embossed wrapper for circumscribing an aerosol-forming substrate of a heated smoking article, the method comprising passing a web of substantially incombustible wrapper material through a pair of nip rollers, one of the rollers in the pair being an embossing roller comprising a profiled surface across a transverse portion of its surface and the other one of the rollers in the pair being a smooth surfaced roller, deforming one side of the web of incombustible material across a portion of its width to create a textured surface, locating an aerosol-forming substrate on the side of incombustible material comprising the textured surface and wrapping the web of incombustible material around the aerosol-forming substrate and adhering the textured surface of the web of incombustible material to an outer, smooth surface of the web of incombustible material.

In certain embodiments, the textured surface comprises about 10 millimetres to about 20 millimetres of the width of the web of substantially incombustible wrapper material.

In certain embodiments, the remaining width of the web of substantially incombustible wrapper material is smooth.

In certain embodiments, the method includes applying an adhesive to the textured surface prior to wrapping the web of incombustible material around the aerosol-forming substrate.

In certain embodiments, the method comprises cutting the wrapped aerosol-forming substrate to form discrete rods of wrapped aerosol-forming substrate.

In certain embodiments, the method comprises combining each discrete rod of wrapped aerosol-forming substrate with one or more of: a cooling element, a spacer element, a filter element, a heat source and a mouthpiece.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'downstream' are used to describe the relative positions of elements, or portions of elements, of the aerosol-generating article in relation to the direction in which a user draws on the aerosol-generating article during use thereof.

The aerosol-generating article comprises two ends: a proximal end through which aerosol exits the aerosol-generating article and is delivered to a user and a distal end. In use, a user may draw on the proximal end in order to inhale aerosol generated by the aerosol-generating article.

The proximal end may also be referred to as the mouth end or the downstream end and is downstream of the distal end. The distal end may also be referred to as the upstream end and is upstream of the proximal end.

As used herein, the term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

In certain embodiments, the aerosol-generating article is a smoking article that generates an aerosol that is directly inhalable into a user's lungs through the user's mouth. More specifically, the aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. More specifically, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

For the avoidance of doubt, in the following description the term 'heating element' is used to mean one or more heating elements.

In preferred embodiments, the aerosol-forming substrate is located at the upstream end of the aerosol-generating article.

As used herein, the term 'longitudinal' in relation to the aerosol-generating article is used to describe the direction between the downstream end and the upstream end of the aerosol-generating article and the term 'transverse' in relation to the aerosol-generating article is used to describe the direction perpendicular to the longitudinal direction.

As used herein, the term 'diameter' in relation to the aerosol-generating article is used to describe the maximum dimension in the transverse direction of the aerosol-generating article. As used herein, the term 'length' in relation to the aerosol-generating article is used to describe the maximum dimension in the longitudinal direction of the aerosol-generating article.

In certain embodiments, the aerosol-forming substrate is a solid aerosol-forming substrate. The aerosol-forming substrate may comprise both solid and liquid components.

In certain embodiments, the aerosol-forming substrate comprises nicotine. More specifically, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

In certain embodiments, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

In certain embodiments, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In certain embodiments, the aerosol-forming substrate comprises homogenised tobacco material.

As used herein, the term 'homogenised tobacco material' denotes a material formed by agglomerating particulate tobacco.

In certain embodiments, the aerosol-forming substrate comprises a gathered sheet of homogenised tobacco material.

As used herein, the term 'sheet' denotes a laminar element having a width and length substantially greater than the thickness thereof.

As used herein, the term "textured" is used to describe an "active" textured surface as opposed to a passive textured surface, thus the term "textured" is used to describe a textured surface that has been artificially created (on the surface) and not an inherent or natural surface condition. By way of example "fibrous paper" could be a passive or natural surface for paper and thus not textured as used herein, whereas embossed, roughened, scored, etched etc are all textured (surfaces) as these surfaces are the result of an active texturing step.

As used herein, the term 'gathered' is used to describe a sheet that is convoluted, folded, or otherwise compressed or constricted substantially transversely to the longitudinal axis of the aerosol-generating article.

Use of an aerosol-forming substrate comprising a gathered sheet of homogenised tobacco material advantageously significantly reduces the risk of 'loose ends' compared to an aerosol-forming substrate comprising shreds of tobacco material, that is the loss of shreds of tobacco material from the ends of the rod. Loose ends may disadvantageously lead to the need for more frequent cleaning of an aerosol-generating device for use with the aerosol-generating article and manufacturing equipment.

Aerosol-forming substrates comprising a gathered sheet of homogenised tobacco material also advantageously exhibit significantly lower weight standard deviations than aerosol-forming substrate comprising shreds of tobacco material. The weight of an aerosol-forming substrate comprising a gathered sheet of homogenised tobacco material of a particular length is determined by the density, width and thickness of the sheet of homogenised tobacco material that is gathered to form the aerosol-forming substrate. The weight of aerosol-forming substrates comprising a gathered sheet of homogenised tobacco material of a particular length can thus be regulated by controlling the density and dimensions of the sheet of homogenised tobacco material. This reduces inconsistencies in weight between aerosol-forming substrates of the same dimensions, and so results in lower rejection rate of aerosol-forming substrates whose weight falls outside of a selected acceptance range compared to aerosol-forming substrate comprising shreds of tobacco material.

Aerosol-forming substrates comprising a gathered sheet of homogenised tobacco material also advantageously exhibit more uniform densities than aerosol-forming substrates comprising shreds of tobacco material.

Aerosol-forming substrates for use in the aerosol-generating article may be known in the art, for example, those disclosed in WO2013/09840A2.

Aerosol-forming substrates comprising gathered sheets of homogenised tobacco for use in the aerosol-generating article may be made by methods known in the art, for example the methods disclosed in WO2012/164009 A2.

The aerosol-generating article may comprise one or more of a support element, an aerosol cooling element and a mouthpiece. More specifically, the mouthpiece is located at the downstream end of the aerosol-generating article.

The support element may comprise a hollow tubular element. In certain embodiments, the support element comprises a hollow cellulose acetate tube.

The support element preferably has an external diameter that is approximately equal to the external diameter of the aerosol-generating article.

The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres plus or minus (+/−) 10 percent.

The support element may have a length of between approximately 5 millimetres and approximately 15 millimetres. In a preferred embodiment, the support element has a length of approximately 8 millimetres.

The support element of the aerosol-generating article resists downstream movement of the aerosol-forming substrate within the aerosol-generating article during insertion of a heating element of an aerosol-generating device into the aerosol-forming substrate. This may help to ensure that the heating element of the aerosol-generating device is fully inserted into the aerosol-forming substrate and so avoid uneven and inefficient heating of the aerosol-forming substrate of the aerosol-generating article.

The aerosol-cooling element may be located downstream of a support element. In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain embodiments, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters). More specifically, the aerosol-cooling element comprises a gathered sheet of polylactic acid.

The aerosol-cooling element may have an external diameter that is approximately equal to the external diameter of the aerosol-generating article.

The aerosol-cooling element may have an external diameter of a diameter of between approximately 5 millimetres and approximately 10 millimetres, for example of between approximately 6 millimetres and approximately 8 millimetres. In a preferred embodiment, the aerosol-cooling element has an external diameter of 7.2 millimetres plus or minus (+/−10) percent.

The aerosol-cooling element may have a length of between approximately 5 millimetres and approximately 25 millimetres. In a preferred embodiment, the aerosol-cooling element has a length of approximately 18 millimetres.

The aerosol-cooling element may be located immediately downstream of the support element and abut the support element.

The aerosol-cooling element may be located between the support element and a mouthpiece located at the extreme downstream end of the aerosol-generating article.

The mouthpiece may be located immediately downstream of the aerosol-cooling element and abut the aerosol-cooling element.

The mouthpiece may comprise a filter. The filter may be formed from one or more suitable filtration materials. Many such filtration materials are known in the art. In certain embodiments, the mouthpiece may comprise a filter formed from cellulose acetate tow.

The mouthpiece may have an external diameter that is approximately equal to the external diameter of the aerosol-generating article.

The mouthpiece may have an external diameter of a diameter of between approximately 5 millimetres and approximately 10 millimetres, for example of between approximately 6 millimetres and approximately 8 millimetres. In certain embodiments, the mouthpiece has an external diameter of 7.2 millimetres plus or minus (+/−) 10 percent.

The mouthpiece may have a length of between approximately 5 millimetres and approximately 20 millimetres. In a preferred embodiment, the mouthpiece has a length of approximately 14 millimetres.

The mouthpiece may have a length of between approximately 5 millimetres and approximately 14 millimetres. In certain embodiments, the mouthpiece has a length of approximately 7 millimetres.

The aerosol-forming substrate, the support element and the aerosol-cooling element and any other elements of the aerosol-generating article, such as the front-plug and mouthpiece where present, are circumscribed by an outer wrapper in addition to the substantially incombustible wrapper circumscribing the aerosol-forming substrate. The outer wrapper may be formed from any suitable material or combination of materials. More specifically, the outer wrapper is a cigarette paper.

In certain embodiments the heating element may be one or more of: a carbonaceous heat source, which can be operated by igniting the heating element, a chemical heat source or a heat sink.

Embodiments of the invention are further described hereinafter with reference to the accompanying drawings, in which:

FIGS. 1*a* to 1*e* are schematic cross-sectional diagrams of an embodiment of an aerosol-generating article showing the substantially incombustible wrapper being applied to the aerosol-forming substrate;

Figure 6A:
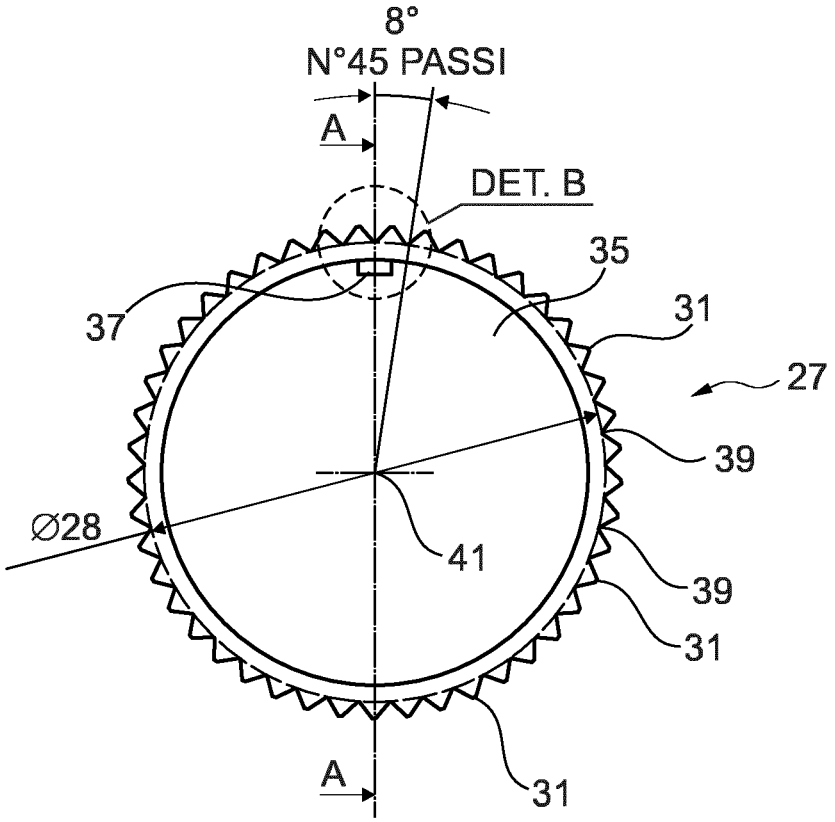
Figure 6B:
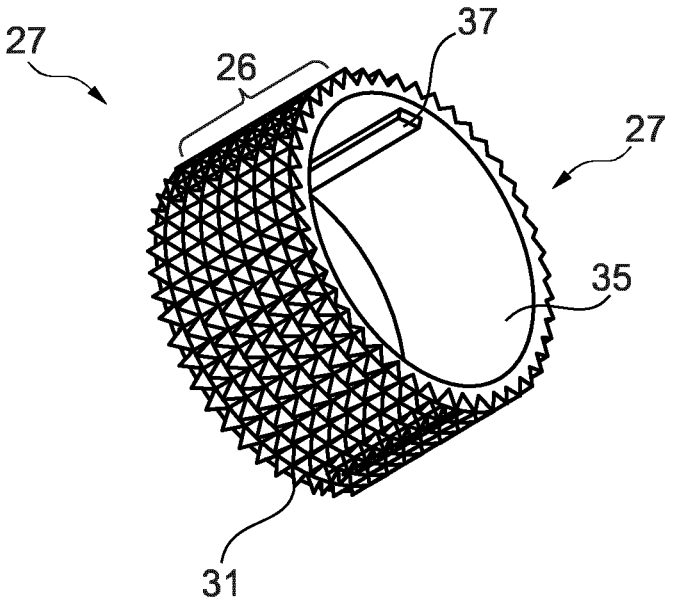
Figure 7:
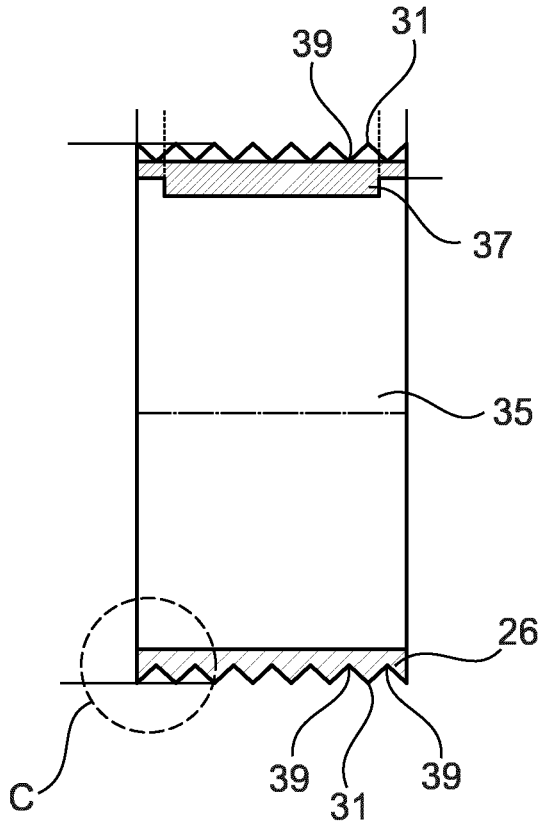
Figure 8A:
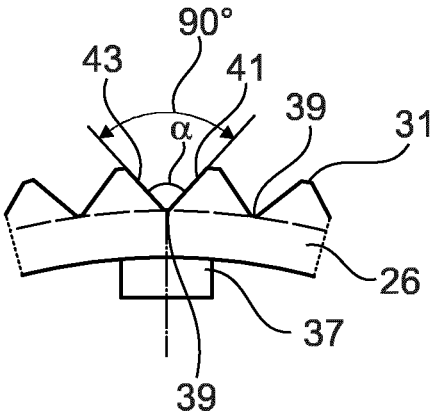
Figure 8B:
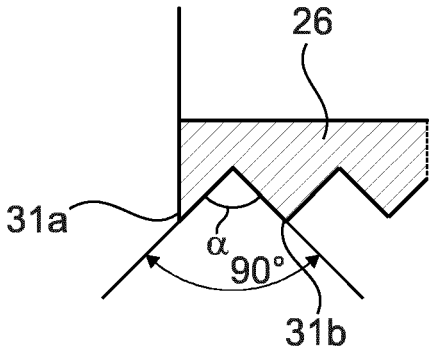
Figure 9:
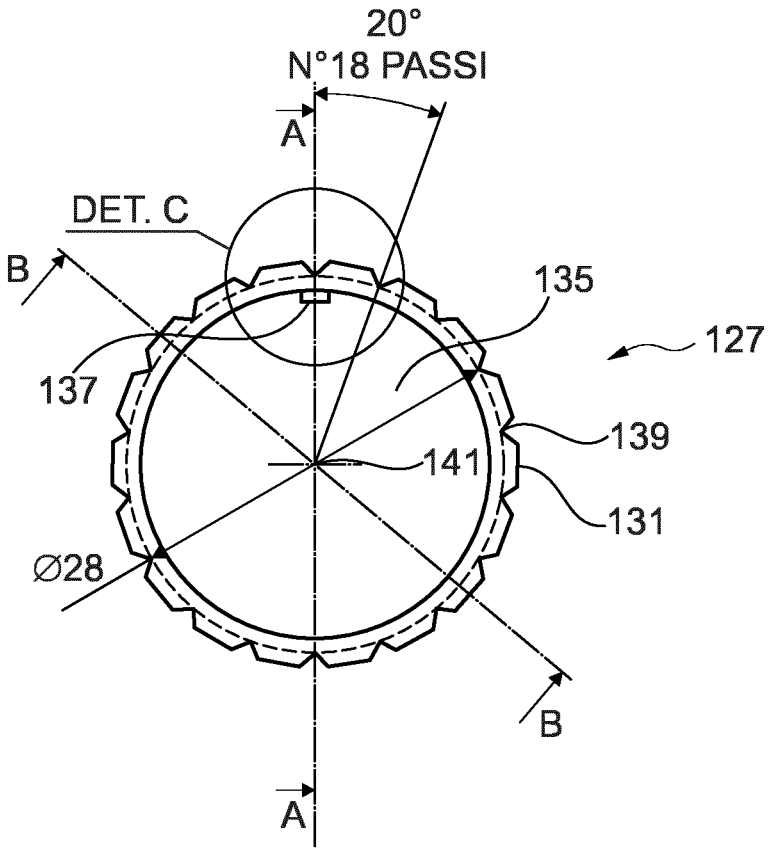
Figure 10:
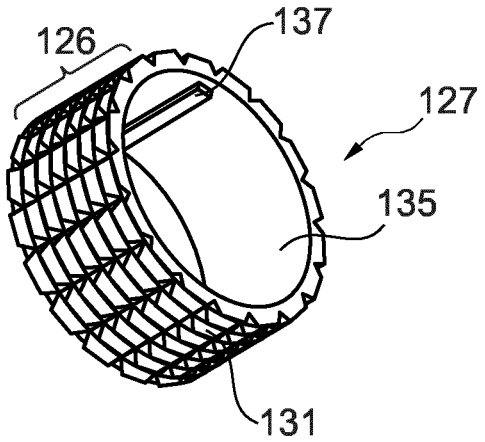
Figure 11A:
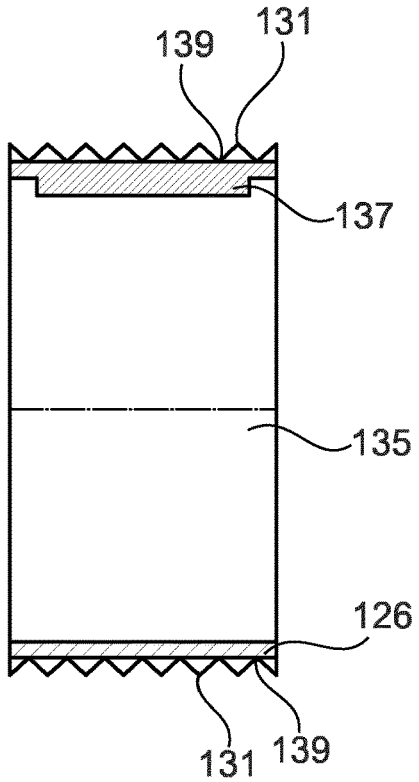
Figure 11B:
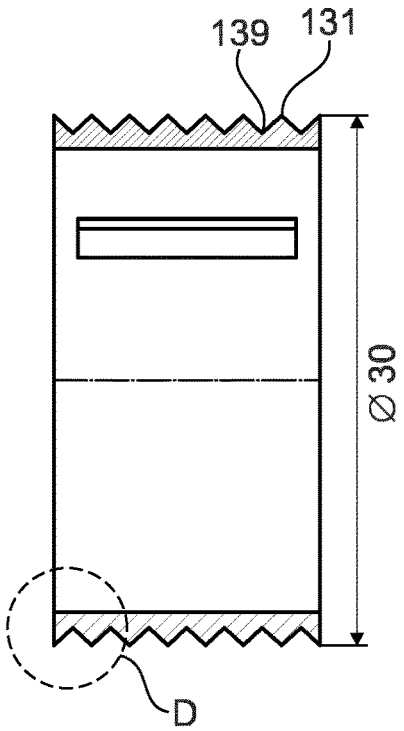
Figure 12A:
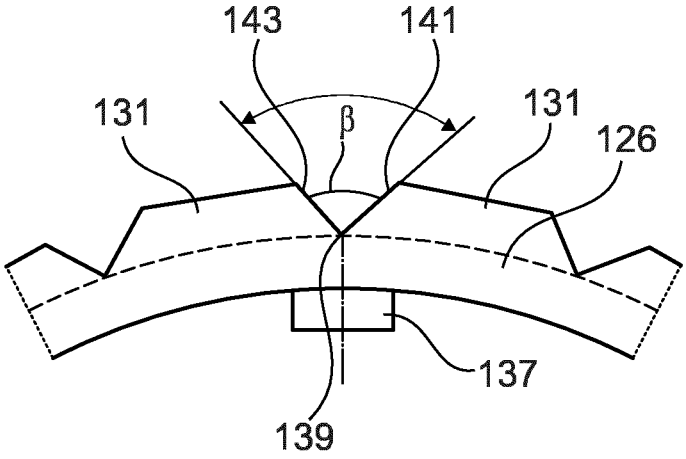
Figure 12B:
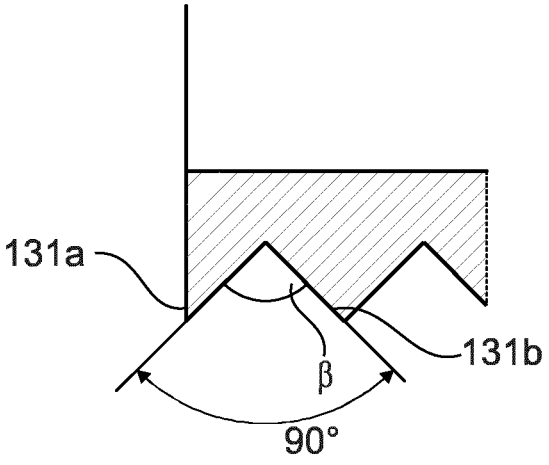
Figure 13:
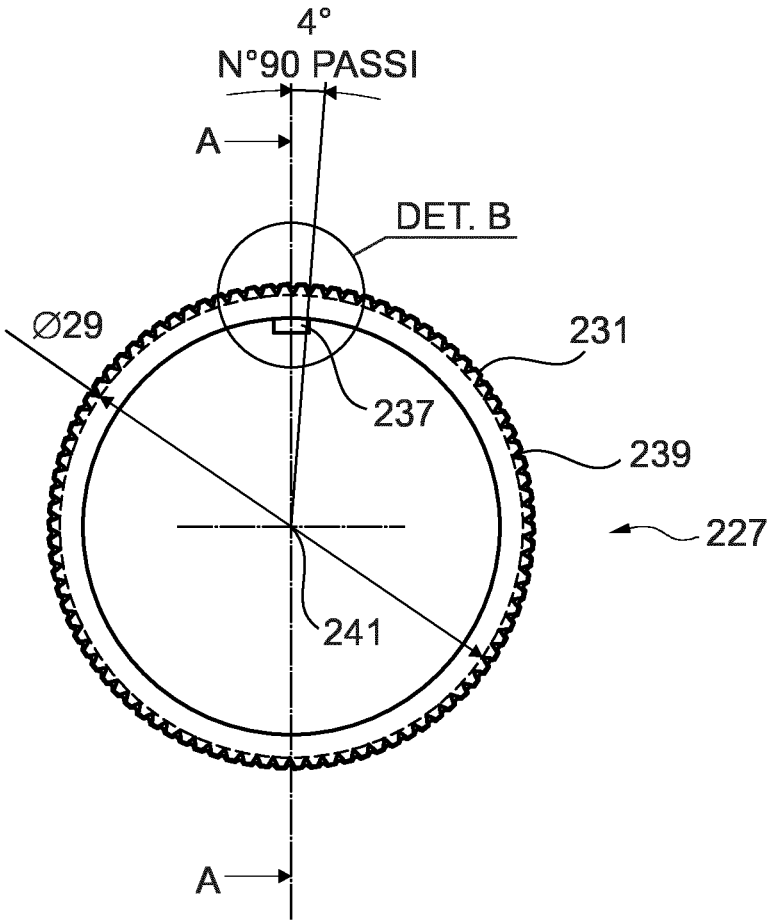
Figure 14:
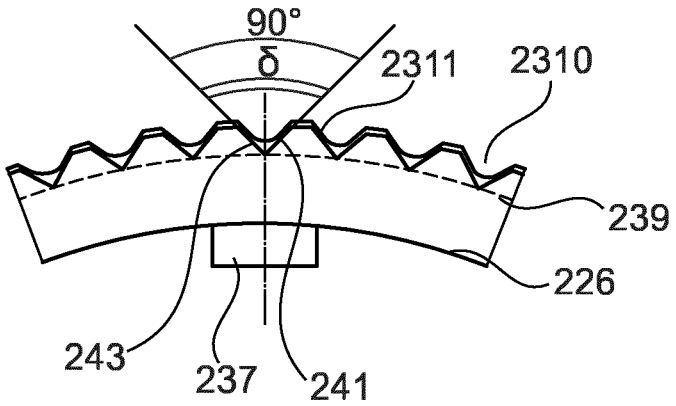
Figure 15:
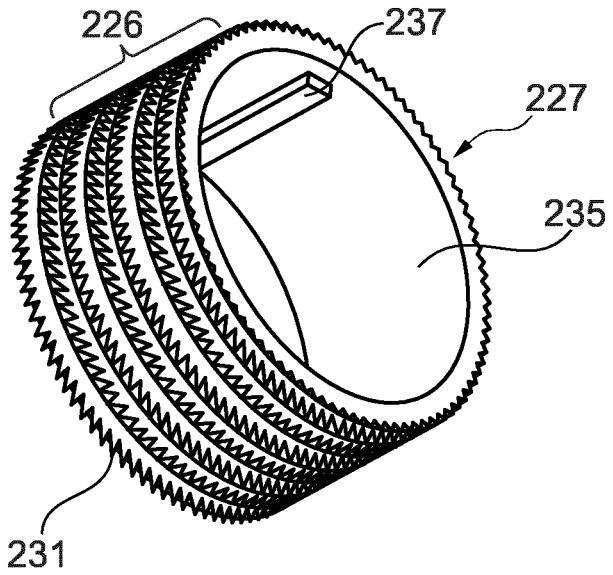
Figure 16:
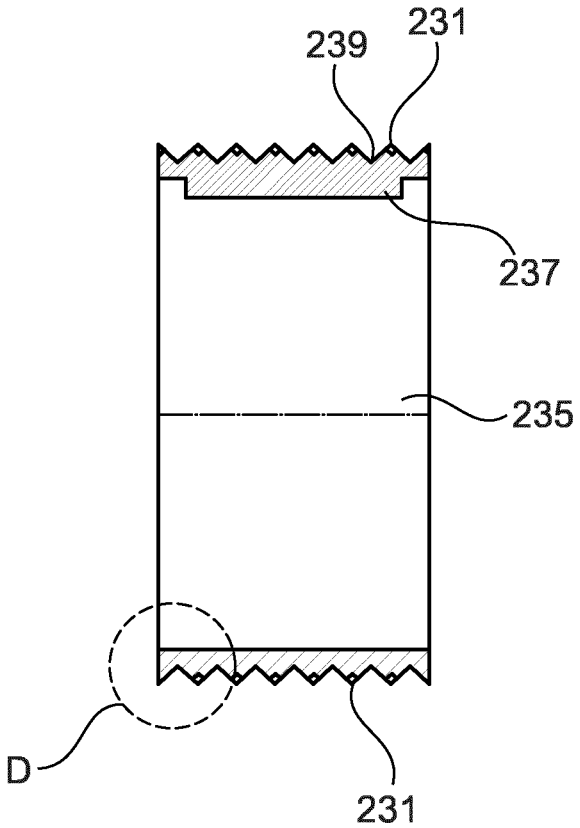
Figure 17:
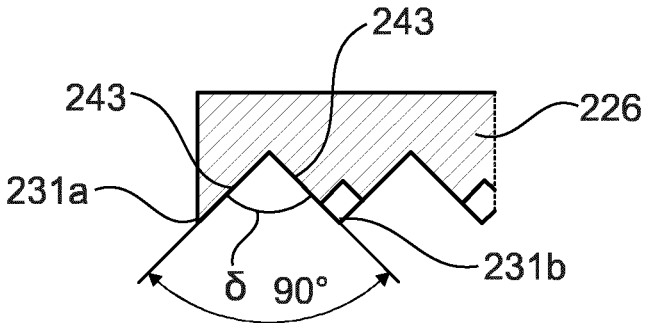
Figure 18:
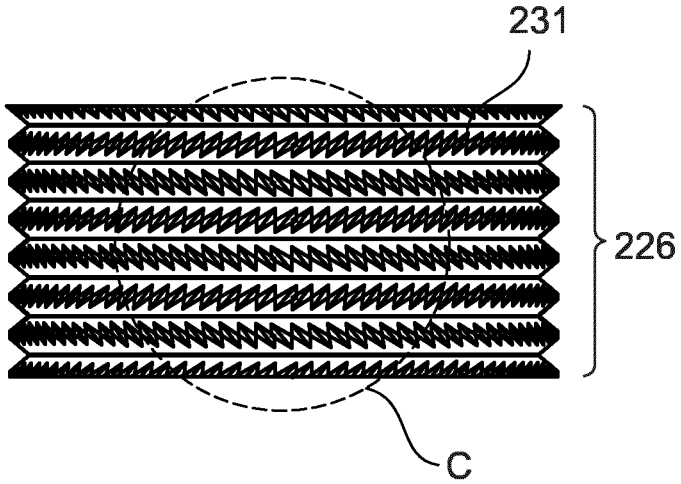
Figure 19:
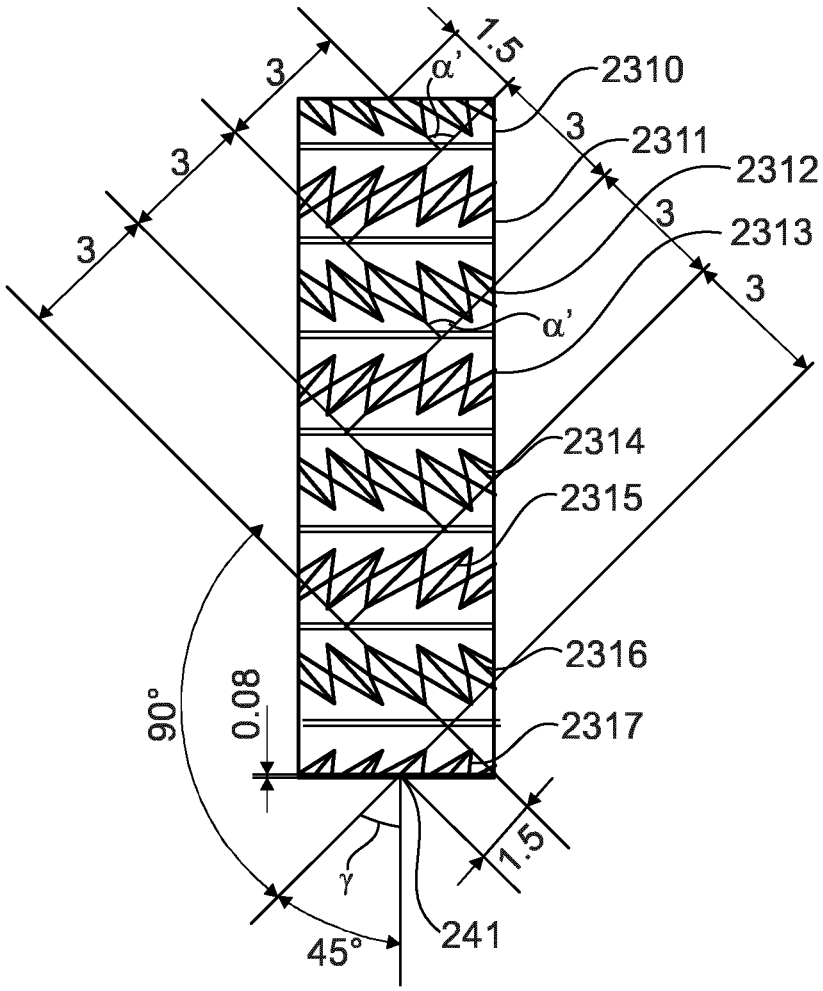

FIGS. 6*a* and 6*b* show a profiled portion of an embossing roller forming part of an embodiment of the apparatus according to the present invention;

FIG. 7 is a cross-sectional view of the profiled portion of FIG. 6*a* along line A-A;

FIGS. 8*a* and 8*b* are exploded views of the profiled portion of FIG. 7 taken in the area denoted as C;

FIG. 9 shows an end plan view of a profiled portion of an embossing roller forming part of another embodiment of the apparatus according to the present invention;

FIG. 10 shows the profiled portion of FIG. 9 in perspective view;

FIG. 11*a* is a cross-sectional view of the profiled portion of FIG. 9 along line A-A;

FIG. 11*b* is a cross-sectional view of the profiled portion of FIG. 9 along line B-B;

FIG. 12*a* is an exploded view of the profiled portion of FIG. 11*a* taken in the area denoted as C;

FIG. 12*b* is an exploded view of the profiled portion of FIG. 11*b* taken in the area denoted as D;

FIG. 13 shows an end plan view of a profiled portion of an embossing roller forming part of a yet further embodiment of the apparatus according to the present invention;

FIG. 14 shows an exploded view of the profiled portion of FIG. 13 taken in the area denoted as B;

FIG. 15 shows the profiled portion of FIG. 13 in perspective view;

FIG. 16 is a cross-sectional view of the profiled portion of FIG. 13 along line A-A;

FIG. 17 is an exploded view of the profiled portion of FIG. 16 taken in the area denoted as D;

FIG. 18 shows the profiled portion of FIG. 13 in plan view from above; and FIG. 19 is an exploded view of the profiled portion of FIG. 18 taken in the area denoted as C.

Where possible, like numerals are used to depict the same features throughout the drawings.

Figure 1A:
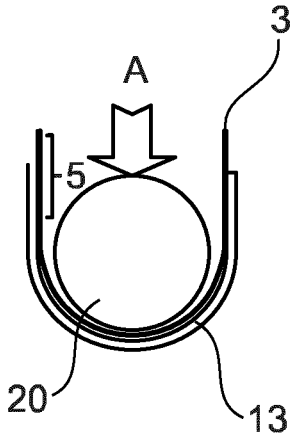
Figure 1B:
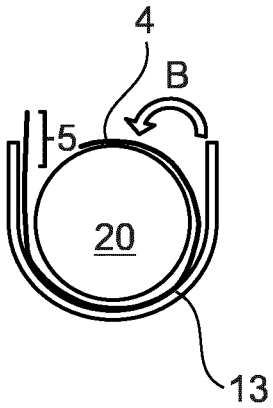
Figure 1C:
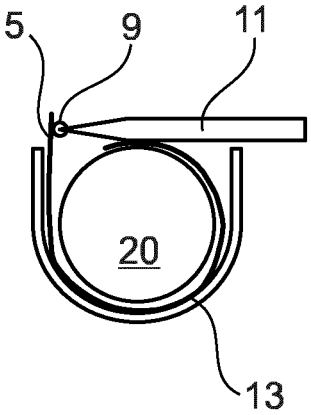
Figure 1D:
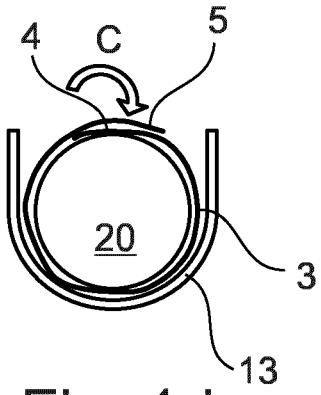

FIGS. 1*a* to 1*e* illustrate the sequential wrapping of an aerosol-forming substrate 20 with a substantially incombustible wrapper 3. In the depicted embodiment, the substantially incombustible wrapper is formed of two layers, bonded together by a lamination process, to form the wrapper 3. The outer layer is a paper plug wrap of basis weight 45 grams per square metre ($gsm^{-1}$) and 65 micrometres (μm) thickness. The inner layer is an aluminium foil of basis weight 17 grams per square metre ($gsm^{-1}$) and 6.3 micrometres (μm) thickness. The substantially incombustible wrapper has a total thickness of 71.3 micrometres (μm). As shown in FIG. 1*a*, the aerosol-forming substrate 20 is delivered, in a direction A, onto an open web of wrapper material on a conveyor or garniture 13. The web of wrapper material 3 is delivered from a pair of rollers (not shown) in which an embossing roller has textured the inner surface of the wrapper to form an embossed portion 5. The embossed portion 5 extends partially across the transverse width of the wrapper 3. The longitudinal dimension of the wrapper 3 is perpendicular to the plane of the drawing. In FIG. 1*b*, one edge of the substantially incombustible wrapper is folded in the direction B onto the aerosol-forming substrate 20. At FIG. 1*c*, adhesive is applied by a glue applicator 11 to the embossed portion 5 on the inner surface of the opposite edge of the substantially incombustible wrapper 3. The embossed portion 5 is folded in a direction C onto a portion 4 of the outer paper surface of the substantially incombustible wrapper 3 in FIG. 1*d*. The embossed portion 5 of the inner surface of the aluminium foil layer is now in contact with the portion 4 of the paper outer layer of substantially incombustible wrapper 3.

Figure 1E:
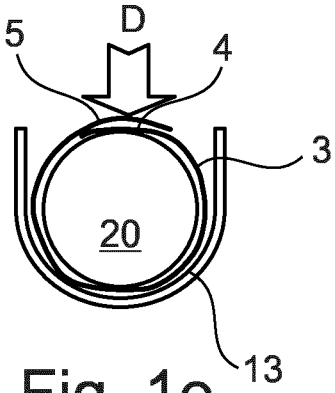

As seen in FIG. 1*e*, vertical pressure is exerted in direction D directly on the substantially incombustible wrapper 3 to ensure adhesion between the embossed portion 5 of the aluminium foil layer to the portion 4 of the paper layer of the substantially incombustible wrapper 3. The embossed portion 5 ensures the non-porous aluminium foil has sufficient surface area for successful adhesion between the aluminium foil and the paper outer of the substantially incombustible wrapper 3 in the area of the lap seam between wrapper portions 5 and 4. Without the embossed portion 5, the metallic aluminium foil layer of the substantially incombustible wrapper 3, which is the inner surface that is glued then pressed on the outside paper surface, is not porous, creating problems with the gluing of the wrapper material. In such arrangements, the aluminium layer of the wrapper is not porous enough to absorb the glue, therefore resulting in a weak glue seam on the aerosol-generating article exiting the tobacco crimper machine. Due to the weak glue seam between the metallic aluminium foil layer of the wrapper and the paper layer, the crimper machine and combiner machine handling the formation of the aerosol-generating article could experience a reduction in performance. For example both of the combiner and the crimper may experience increased downtime and waste to remove defective product resulting in potentially large volume losses. The substantially incombustible wrapper 3 of the invention mitigates the potential losses experienced in products with a weak glue seam in the wrapper.

As shown in FIG. 1*e*, the aerosol-forming substrate 20, is wrapped in a substantially incombustible wrapper 3 formed of a metallic, heat conducting layer in contact with the aerosol-forming substrate 20 and a paper plug wrap outer layer. The layers may be bonded together in a lamination process to form the substantially incombustible wrapper 3.

The inner aluminium layer is the inside layer in contact with the aerosol-forming substrate 20. This layer has a heat conducting function. Alternatively, or in addition, the inner aluminium layer may prevent product lighting when extending over an integral heat source.

The outer layer of the substantially incombustible wrapper 3 is made of paper. Because this layer is on the outside, it is important that the visual aspect and qualitative look of this layer are of a high standard. The partial thickness of the embossing of the inner layer of the substantially incombustible wrapper 3 means that the appearance of the paper outer layer is not altered by the embossing pattern.

Figure 2:
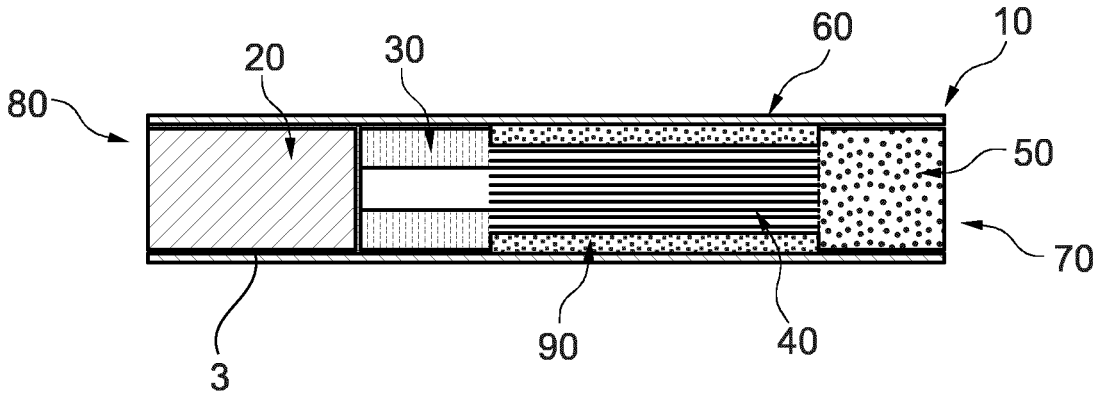
FIG. 2 is a schematic cross-sectional diagram of an embodiment of an aerosol-generating article for use with an aerosol-generating device comprising a heating element.

FIG. 2 illustrates an aerosol-generating article 10 according to an embodiment of the invention. The aerosol-generating article 10 comprises four elements arranged in coaxial alignment: an aerosol-forming substrate 20, a support element 30, an aerosol-cooling element 40, and a mouthpiece 50. These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 2, aerosol-forming substrate 20 comprises a gathered sheet of crimped homogenised tobacco material circumscribed by a substantially incombustible wrapper 3. The crimped sheet of homogenised tobacco material comprises comprising glycerine as an aerosol-former. The substantially incombustible wrapper 3 is formed of a laminated plug wrap having a paper outer layer and an aluminium inner layer. The inner aluminium layer is embossed (textured) across a portion of its traverse width so as to provide an embossed region of the inner layer that will overlap a portion of the paper outer layer when the substantially incombustible wrapper 3 circumscribes the aerosol-forming substrate 20. The aluminium inner layer is impervious to the applied adhesive. By texturing the inner surface of the aluminium inner layer, the adhesion of the inner layer to the paper outer layer is increased. This increased adhesion prevents the gaping, or partial opening, of the lap seam between the edges of the substantially incombustible wrapper 3 during the assembly of the aerosol-generating article 10.

The support element 30 is located immediately downstream of the aerosol-forming substrate 20 and abuts the aerosol-forming substrate 20. In the embodiment shown in FIG. 2, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. The support element 30 acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 2, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 2, the mouthpiece 50 comprises a conventional cellulose acetate tow filter of low filtration efficiency.

To assemble the aerosol-generating article 10, initially the aerosol-forming substrate 20 may be wrapped within substantially incombustible wrapper 3 in accordance with the steps shown in FIG. 1. The four elements described above, including the wrapped aerosol-forming substrate 20, are then aligned and tightly wrapped within the outer wrapper 60. In the embodiment illustrated in FIG. 2, the outer wrapper is a conventional cigarette paper. As shown in FIG. 2, an optional row of perforations is provided in a region of the outer wrapper 60 circumscribing the support element 30 of the aerosol-generating article 10.

In the embodiment illustrated in FIG. 2, a distal end portion of the outer wrapper 60 of the aerosol-generating article 10 is circumscribed by a band of tipping paper (not shown).

The aerosol-generating article 10 illustrated in FIG. 2 is designed to engage with an aerosol-generating device comprising a heating element in order to be smoked or consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

Figure 3:
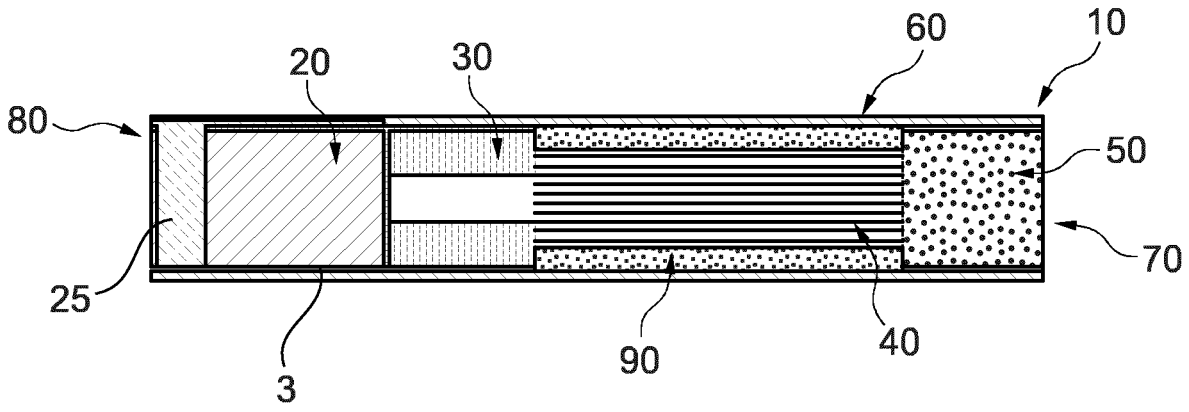
FIG. 3 is a schematic cross-sectional diagram of an embodiment of an aerosol-generating article comprising an integral heating element.

FIG. 3 illustrates an aerosol-generating article 100 according to an embodiment of the invention. The aerosol-generating article 100 comprises five elements arranged in coaxial alignment: an integral heat source 25, an aerosol-forming substrate 20, a support element 30, an aerosol-cooling element 40, and a mouthpiece 50. These five elements are arranged sequentially and are circumscribed by an outer wrapper 60 to form the aerosol-generating article 10. The aerosol-generating article 100 illustrated in FIG. 3 differs from the aerosol-generating article 10 of FIG. 2 in that it comprises an integral heat source 25 at the distal end of the aerosol-forming substrate 20 and which abuts the aerosol-forming substrate 20. Substantially incombustible wrapper 3 circumscribes the aerosol-forming substrate 20 and the entire length of the integral heat source 25 in this embodiment. By covering the integral heat source 25, which is a carbon heat source 25, the substantially incombustible wrapper 3 prevents lighting of the integral heat source. The wrapper 3 may need to be partially removed from the heat source 25 before ignition or actuation.

The aerosol-generating article 100 illustrated in FIG. 3 is designed to have a user ignite the integral heat source 25 in order for the article to be smoked or consumed by a user. In use, the integral heat source 25 heats the aerosol-forming substrate 20 of the aerosol-generating article 100 to a sufficient temperature to form an aerosol, which is drawn downstream through the aerosol-generating article 100 and inhaled by the user.

Figure 4:
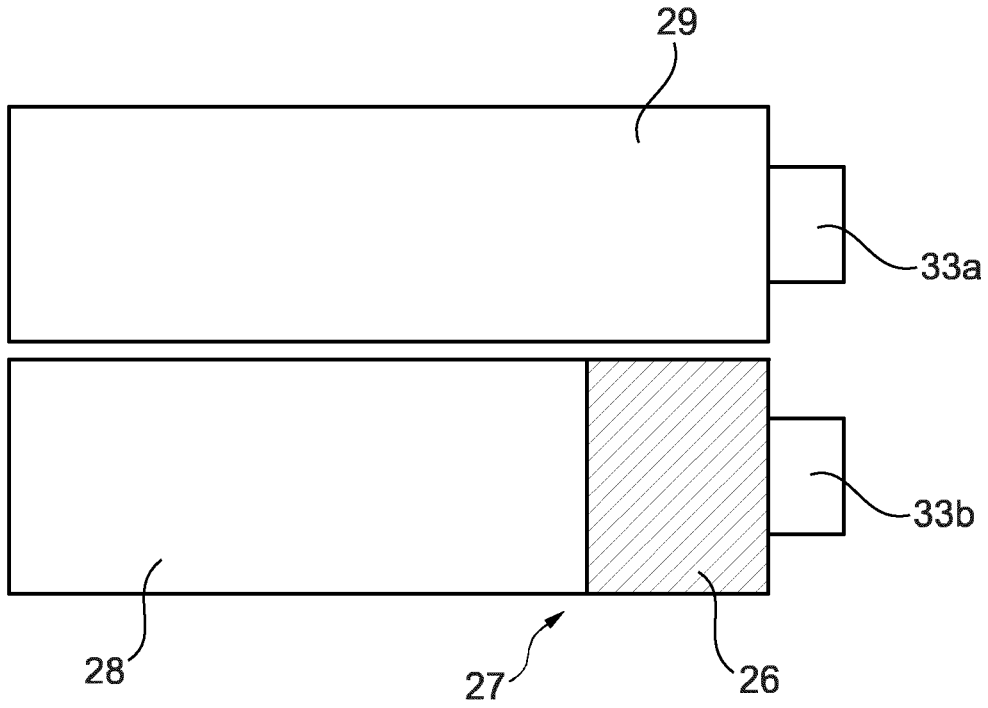
FIG. 4 is a schematic diagram of an embodiment of a pair of rollers (roller and counter roller) forming part of the apparatus according to the invention.

FIG. 4 shows a pair of rollers (roller and counter roller) forming part of the apparatus according to the invention. The pair of rollers comprises an embossing roller 27 having an embossing surface portion 26 and a smooth surface portion 28. Only a part of the embossing roller surface comprises embossing teeth 31. In use, the embossing roller 27 will contact the inner aluminium foil layer of the wrapper material (not shown), and the embossing surface portion 26, comprising teeth 31, covers the area of the inner layer of the substantially incombustible wrapper that will overlap the outer surface of the wrapper material when the adhesive is applied and the two portions overlapped as shown in FIGS. 1*a* to 1*e*. The counter roller, that is the smooth surface roller 29, will be in contact with the outer layer of the wrapper material. The smooth surface roller 29 ensures that the outer layer of the substantially incombustible wrapper will not be altered by the embossing process.

Each of the pair of rollers 27, 29 is mounted onto a shaft 33*a*, 33*b* which is mountable onto a crimper machine (not shown) downstream of the aerosol-forming substrate crimper (not shown). The shafts 33*a*, 33*b* of the rollers may be free moving or motorized. If the shafts are free moving, the rollers are easy to install.

An endless screw (not shown) may be provided, which is operated by an operator using a handle and which allows adjustment of the distance between the embossing roller 27 and the smooth surface roller 29. Adjusting the distance between the surfaces of the rollers 27, 29 changes the depth of the embossing on the inner surface of the substantially incombustible wrapper 3 passed between the rollers 27, 29.

Figure 5:
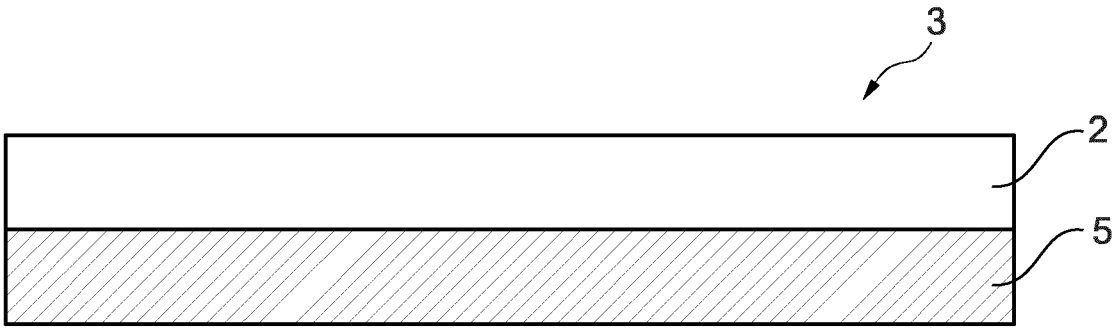
FIG. 5 is a web of substantially incombustible wrapper material having a textured profile formed by the pair of roller of FIG. 4.

FIG. 5 illustrates the inner surface of a web of substantially incombustible wrapper 3 following processing through the pair of rollers of FIG. 4. The embossed portion 5 extends along the full length of the web and partially across the transverse width of the web of substantially incombustible wrapper. The smooth portion 2 of the inner surface of the web of substantially incombustible wrapper 3 remains smooth. In this way, the smooth portion of the inner surface of the substantially incombustible wrapper 3 will form an intimate contact with the rod of aerosol-forming substrate when the wrapper 3 circumscribes the rod of aerosol-forming substrate.

FIGS. 6*a* to 8*b* depict a profiled portion of an embossing roller forming part of the apparatus according to the present invention. FIGS. 9 to 12*b* depict an alternative profiled portion of an embossing roller forming part of the apparatus according to the present invention. FIGS. 13 to 19 depict a further alternative profiled portion of an embossing roller forming part of the apparatus according to the present invention. Similar features in each embodiment of the embossing roller are denoted by similar reference numerals, increased by a factor of 100.

FIG. 6*a* is an end plan view of a profiled portion 26 of the embossing roller 27. FIG. 6*b* is a perspective view of the profiled portion 26. Referring to FIG. 6*a*, the surface of the profiled portion 26 comprises a plurality of teeth 31 with adjacent teeth 31 separated by recesses 39 around the entire circumference of the embossing roller 27. 45 teeth are arranged around the circumference of the embossing roller 27 with each tooth occupying a circumferential angle of 8 degrees measured from the longitudinal axis of the roller 27 including centre point 41 of the hollow core 35 of the embossing roller. The diameter of the embossing roller 27 measured to the points of the teeth is 30 millimetres. The diameter of the embossing roller 27 measured to the bottom of recesses 39 is 28 millimetres. In the embodiment depicted in FIGS. 6*a* to 8, the teeth 31 are 2 millimetres in height from the base of the adjacent recess 39 to the point of the tooth 31.

FIG. 6*b* shows the profiled portion 26 of teeth shown in FIG. 6*a* extending transversely across the width of the profiled portion 26. It will be understood that only the profiled portion 26 of the embossing roller is shown in the embodiment and the smooth surface of the remaining transverse width of the embossing roller 27 is not shown. The hollow core 35 allows the embossing roller 27 to fit onto a shaft (see 33*a*, 33*b* in FIG. 4) and locating flange 37 ensures the shaft and the roller 27 rotate together.

FIG. 7 is a cross-sectional view of the profiled portion 26 of embossing roller 27 of FIG. 6*a* along line A-A. The hollow core 35 has a diameter of 26 millimetres excluding locating flange 37. The teeth 31 and adjacent recesses 39 extends across the width of profiled portion 26.

FIGS. 8*a* and 8*b* are exploded views of the profiled portion of FIG. 7 taken in the area denoted as C. Each tooth 31 has a first face 41 and a second face 43 joining at the base of a recess 39. The first face 41 of a first tooth 31*a* and the second face 43 of an adjacent second tooth 31*b* are at an angle α of 90 degrees to one another in the depicted embodiment.

FIG. 9 shows an end plan view of a profiled portion 126 of an embossing roller 127 forming part of the apparatus according to the present invention. FIG. 9 is an end plan view of a profiled portion 126 of the embossing roller 127. FIG. 10 is a perspective view of the profiled portion 126. Referring to FIG. 9, the surface of the profiled portion 126 comprises a plurality of teeth 131 with adjacent teeth 131 separated by recesses 139 around the entire circumference of the embossing roller 127. Each tooth 131 has a flattened point (tip). 18 teeth 131 are arranged around the circumference of the embossing roller 127 with each tooth occupying a circumferential angle of 20 degrees measured from the longitudinal axis of the roller 127 including centre point 141 of the hollow core 135 of the embossing roller. The diameter of the embossing roller 127 measured to the flattened point of the teeth is 30 millimetres. The diameter of the embossing roller 127 measured to the bottom of recesses 139 is 28 millimetres. In the embodiment depicted in FIGS. 9 to 12*b*, the teeth 131 are 2 millimetres in height from the base of the adjacent recess 139 to the flattened point of the tooth 131.

FIG. 10 shows the profiled portion 126 of teeth shown in FIG. 9 extending transversely across the width of the profiled portion 126. It will be understood that only the profiled portion 126 of the embossing roller is shown in the embodiment and the smooth surface of the remaining transverse width of the embossing roller 127 is not shown. The hollow core 135 allows the embossing roller 127 to fit onto a shaft (see 33*a*, 33*b* in FIG. 4) and locating flange 137 ensures the shaft and the roller 27 rotate together.

FIG. 11*a* is a cross-sectional view of the profiled portion 126 of embossing roller 127 of FIG. 9 taken along line A-A and FIG. 11*b* is a cross-sectional view of the profiled portion 126 of embossing roller 127 of FIG. 9 taken along line B-B. The hollow core 135 has a diameter of 26 millimetres excluding locating flange 137. The teeth 131 and adjacent recesses 139 extend across the width of profiled portion 126.

FIG. 12*a* is an exploded view of the profiled portion of FIG. 11*a* taken in the area denoted as C. Each tooth 131 has a first face 141 and a second face 143 joining at the base of a recess 139. As illustrated in FIG. 12*b*, which is an exploded view of the profiled portion of FIG. 11*b* taken in the area denoted as D, the first face 141 of a first tooth 131*a* and the second face 143 of an adjacent second tooth 131*b* are at an angle β of 90 degrees to one another in the depicted embodiment.

FIG. 13 shows an end plan view of a profiled portion 226 of an embossing roller 227 forming part of a yet further embodiment of the apparatus according to the present invention.

FIG. 13 is an end plan view of a profiled portion 226 of the embossing roller 227. The surface of the profiled portion 226 comprises a plurality of teeth 231 with adjacent teeth 231 separated by recesses 239 around the entire circumference of the embossing roller 227. As best shown in FIG. 19, each tooth 231 has a tip offset from the longitudinal axis of the profiled portion 226 which axis includes centre point 241. The angle of offset y is 45 degrees in the depicted embodiment. In this way, the tip of each tooth 231 has both a transverse and a circumferential dimension. FIG. 19 also depicts rows of teeth extending across the transverse width of the profiled portion 226. The rows of teeth, 2310, 2311, 2312, 2313, 2314, 2315, 2316, 2317 are 3 millimetres in dimension when measured along the tip of each tooth 231.

The tips of the teeth 231 in each adjacent row are at an angle α' of 90 degrees to one another.

FIG. 13 shows 90 teeth 231 arranged in a row around the circumference of the embossing roller 227 with each tooth occupying a circumferential angle of 4 degrees measured from the longitudinal axis of the roller 227 including centre point 241 of the hollow core 235 of the embossing roller. The diameter of the embossing roller 227 measured to the point of the teeth is 30 millimetres. The diameter of the embossing roller 227 measured to the bottom of recesses 239 is 29 millimetres. In the embodiment depicted in FIGS. 13 to 19, the teeth 231 are 1 millimetre in height from the base of the adjacent recess 239 to the point of the tooth 231.

FIG. 15 shows the profiled portion 226 comprising rows of teeth 231 extending transversely across the width of the profiled portion 226. It will be understood that only the profiled portion 226 of the embossing roller is shown in the embodiment and the smooth surface of the remaining transverse width of the embossing roller 227 is not shown. The hollow core 235 allows the embossing roller 227 to fit onto a shaft (see 33*a*, 33*b* in FIG. 4) and locating flange 237 shown in FIG. 16 ensures the shaft and the roller 227 rotate together.

FIG. 16 is a cross-sectional view of the profiled portion 226 of embossing roller 227 of FIG. 13 taken along line A-A. The hollow core 235 has a diameter of 26 millimetres excluding locating flange 237. The teeth 231 and adjacent recesses 239 extend across the width of profiled portion 226.

FIG. 17 is an exploded view of the profiled portion 226 of FIG. 16 taken in the area denoted as D. Each tooth 231 has a first face 241 and a second face 243 joining at the base of a recess 239. The first face 243 of a first tooth 231*a* and the second face 241 of an adjacent second tooth 231*b* are at an angle δ of 90 degrees to one another in the depicted embodiment.

FIG. 14 is an exploded view taken at area B in FIG. 13. The profiled portion 226 comprises rows of teeth 2310 and 2311, the points of which rows of teeth are set at an angle of 90 degrees to one another.

The faces 241 and 243 of adjacent teeth, together forming recess 239, are at an angle δ to one another.

As can be seen, various profiles of teeth are envisaged. The height of each tooth is less than the thickness of the inner heat conducting layer of the substantially incombustible wrapper. In this way, the embossing roller can texture the inner surface of the substantially incombustible wrapper without affecting the outer surface of the substantially incombustible wrapper. The embossed surface does not penetrate or otherwise break through the entire thickness of the substantially incombustible wrapper. In this way, the embossed surface provides a textured surface portion on the inner layer of the substantially incombustible wrapper to improve the adhesion between overlapping layers of the substantially incombustible wrapper without affecting the quality or appearance of the outer layer.

The height of the teeth on the embossed roller may be 1 millimetre or more. The relatively larger height dimension of the teeth is possible because the outer layer of the substantially incombustible wrapper is held against the smooth surface of the counter roller and because the distance between the rollers is adjustable, so that whatever the size of the teeth, the depth of the embossing may be adjusted accordingly without affecting the quality or appearance of the outer layer.

The various embossing rollers having different teeth profiles each have a hollow core of the same diameter (between about 8 millimetres to about 36 millimetres, preferably 26 millimetres), so that they can be easily and quickly mounted on the same shaft which can be fixed on to the crimper machine. The rollers may be fixed to the shaft using a cotter pin to prevent rotation of the roller relative to the shaft.

During the process of making the aerosol-forming article of the invention, the substantially incombustible wrapper material may be closed around the aerosol-forming substrate and the overlapping edges adhered to one another using adhesive (for example glue). The gluing process may be part of a larger process which involves the crimping of the aerosol-forming substrate (by a "Crimper machine", not shown) which inputs aerosol-forming substrate and substantially incombustible wrapper material onto the conveyor (13 in FIGS. 1*a* to 1*e*), and which outputs rods of wrapped aerosol-forming substrate. The rods of wrapped aerosol-forming substrate are then used in a "Combiner machine" which combines filters and other components to the rods of wrapped aerosol-forming substrate so as to form the final product.

The manufacturing process may proceed by folding the substantially incombustible wrapper around the longitudinal axis of a rod of aerosol-forming substrate then applying seam glue along one edge of the inner surface of the inner layer (for example the surface in contact with the aerosol-forming substrate) of the substantially incombustible wrapper and then pressing the glued area on to the top surface of the other edge of the substantially incombustible wrapper.

Using the pair of rollers shown in FIG. 4, for example, the inner layer of the substantially incombustible wrapper, that is the layer in contact with the aerosol-forming substrate and which will overlap the outside layer of the substantially incombustible wrapper following the gluing process, is embossed to create a roughened profile of the inner surface of the inner layer of the substantially incombustible wrapper. The embossing increases the contact area of the surface of the inner layer of the substantially incombustible wrapper in the region of overlap with the outer surface of the outer layer. This provides better bonding of the substantially incombustible wrapper at the seam.

During the wrapping of the aerosol-forming substrate in the substantially incombustible wrapper, a web of substantially incombustible wrapper material may be pulled by the crimper machine between the pair of rollers. The axes of the embossing and the smooth surfaced rollers of the pair of rollers may be oriented to be orthogonal to the direction of travel of the web of substantially incombustible wrapper material.

The profiled portion of the embossing roller creates a textured portion on the inner layer of the substantially incombustible wrapper in an area that will be overlapping the outer layer when the wrapper is closed about the aerosol-forming substrate, but does not necessarily cover all the inner layer surface. In this way, the smooth inner surface of the inner layer can form an intimate contact with the aerosol-forming substrate.

The height of the teeth on the embossing roller is such that the appearance of the outer layer is not changed by the embossing process. Alternatively, or in addition, the distance between the embossing roller and the smooth surfaced roller is such that the appearance of the outer layer is not changed by the embossing process.

As a result of the improved adhesion of the embossed non-porous (for example metallic) portion of the inner layer to the smooth outer layer of the substantially incombustible wrapper, the quality of the rods of wrapper aerosol-forming substrate may be improved and the volume of waste or rejected product may be reduced.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. An aerosol-generating article for use with an aerosol-generating device comprising a heating element, the aerosol-generating article comprising:

an aerosol-forming substrate; and a substantially incombustible wrapper circumscribing the aerosol-forming substrate and comprising inner and outer surfaces;

wherein the inner surface of the substantially incombustible wrapper has an at least partially textured embossed surface configured to overlap a portion of the outer surface of the substantially incombustible wrapper when the substantially incombustible wrapper is wrapped around the aerosol-forming substrate, the at least partially textured embossed surface increasing a surface area of the inner surface of the substantially incombustible wrapper to which adhesive can be applied thereby increasing an adhesion force between the inner surface of the substantially incombustible wrapper and the overlapped portion of the outer surface of the substantially incombustible wrapper, and wherein the at least partially textured embossed surface extends partially around a circumference of the aerosol-forming substrate, and wherein the outer surface of the substantially incombustible wrapper is smooth, with the at least partially textured embossed surface of the inner surface of the substantially incombustible wrapper extending through a partial thickness of the substantially incombustible wrapper so as not to affect an external appearance of the aerosol-generating article.

2. An aerosol-generating article according to claim 1, wherein the textured embossed surface is between about 10 millimetres and about 20 millimetres wide.

3. An aerosol-generating article according to claim 1, wherein the textured embossed surface is between 0.5 millimetres and 10 millimetres wide; or between 1 millimetre and 8 millimetres wide; or between 1 millimetre and 6 millimetres wide; or between 1 millimetre and 5 millimetres wide; or between 2 millimetres and 5 millimetres wide.

4. An aerosol-generating article according to claim 1, wherein at least the inner surface of the substantially incombustible wrapper is metallic.

5. An aerosol-generating article according to claim 4, wherein the textured embossed surface of the metallic inner surface is adhesively joined to the outer surface of an opposite edge of the substantially incombustible wrapper.

6. An aerosol-generating article according to claim 1, wherein the substantially incombustible wrapper comprises two layers, an innermost layer and an outer layer circumscribing the innermost layer.

7. An aerosol-generating article according to claim 1, wherein the substantially incombustible wrapper extends over at least a portion of a length of the aerosol-forming substrate.

8. An aerosol-generating article according to claim 1, wherein the aerosol-forming substrate comprises tobacco.

9. An aerosol-generating article according to claim 1, wherein the aerosol-forming substrate comprises a source of nicotine.

10. An aerosol-generating article comprising:

an aerosol-forming substrate comprising one or more of tobacco and a source of nicotine;

a heating element at an upstream end of the aerosol-forming substrate and being arranged to heat the aerosol-forming substrate so as to form an aerosol when actuated;

a substantially incombustible wrapper circumscribing the aerosol-forming substrate and at least a portion of the heating element, the substantially incombustible wrapper comprising inner and outer surfaces;

wherein the inner surface of the wrapper has an at least partially textured embossed surface configured to overlap a portion of the outer surface of the substantially incombustible wrapper when the substantially incombustible wrapper is wrapped around the aerosol-forming substrate, the at least partially textured embossed surface increasing a surface area of the inner surface of the wrapper to which adhesive can be applied thereby increasing an adhesion force between the inner surface of the wrapper and the overlapped portion of the outer surface of the wrapper, and wherein the at least partially textured surface extends partially around the circumference of the aerosol forming substrate;

wherein the outer surface of the substantially incombustible wrapper is smooth, with the at least partially textured embossed surface of the inner surface of the substantially incombustible wrapper extending through a partial thickness of the substantially incombustible wrapper so as not to affect an external appearance of the aerosol-generating article.

11. A method of forming an embossed wrapper for circumscribing an aerosol-forming substrate of a heated smoking article, the method comprising passing a web of substantially incombustible wrapper material through a pair of nip rollers, one of the rollers in the pair being an embossing roller comprising a profiled surface across a transverse portion of its surface and the other one of the rollers in the pair being a smooth surfaced roller, deforming one side of the web of incombustible material across a portion of its width to create a textured surface, locating an aerosol-forming substrate on the side of incombustible material comprising the textured surface and wrapping the web of incombustible material around the aerosol-forming substrate and adhering the textured surface of the web of incombustible material to an outer, smooth surface of the web of incombustible material;

wherein the textured surface of the substantially incombustible wrapper extending through a partial thickness of the substantially incombustible wrapper so as not to affect an external appearance of the heated smoking article.

12. A method of forming an aerosol-generating article comprising embossing an inner surface of an substantially incombustible wrapper, forming a rod of aerosol-forming substrate on the embossed wrapper, circumscribing the aerosol-forming substrate with the embossed wrapper, applying adhesive to a portion of the embossed inner surface which portion overlaps a portion of an outer surface of the wrapper, closing the wrapper about the aerosol-forming substrate by adhering the overlapping portion of the embossed inner surface to the outer surface of the wrapper;

wherein the outer surface of the substantially incombustible wrapper is smooth, with the embossed inner surface extending through a partial thickness of the substantially incombustible wrapper so as not to affect an external appearance of the aerosol-generating article.

* * * * *